US007882672B2

(12) United States Patent
Emblin

(10) Patent No.: US 7,882,672 B2
(45) Date of Patent: Feb. 8, 2011

(54) BUILDING PANELS

(75) Inventor: Alan Gayne Emblin, Cooroy (AU)

(73) Assignee: Building Solutions Pty Ltd., Cooroy, Queensland (AU)

( * ) Notice: Subject to any disclaimer, the term of this patent is extended or adjusted under 35 U.S.C. 154(b) by 823 days.

(21) Appl. No.: 10/568,787

(22) PCT Filed: Aug. 25, 2004

(86) PCT No.: PCT/AU2004/001134

§ 371 (c)(1),
(2), (4) Date: Aug. 23, 2006

(87) PCT Pub. No.: WO2005/019552

PCT Pub. Date: Mar. 3, 2005

(65) Prior Publication Data

US 2007/0193169 A1 Aug. 23, 2007

(30) Foreign Application Priority Data

Aug. 25, 2003 (AU) ..... 2003904535

(51) Int. Cl.
*E04B 2/86* (2006.01)

(52) U.S. Cl. ..... 52/426; 52/383; 52/562; 52/566

(58) Field of Classification Search ..... 52/566, 52/426, 838, 562, 565, 383, 309.11, FOR. 122, 52/837, 690, 696, 840, 841
See application file for complete search history.

(56) References Cited

U.S. PATENT DOCUMENTS 1,085,429 A * 1/1914 Kahn et al. ..... 52/838
2,228,363 A 1/1941 Pinney
2,276,040 A * 3/1942 Hull ..... 52/377
3,114,179 A 12/1963 Briggs
3,336,713 A 8/1967 Privas
3,344,572 A * 10/1967 Sell ..... 52/426
3,517,472 A 6/1970 Toth
3,531,901 A 10/1970 Will, Jr. et al.
3,685,222 A 8/1972 Curtess
3,688,460 A * 9/1972 Van Loghem et al. ..... 52/466

(Continued)

FOREIGN PATENT DOCUMENTS

AU 671957 4/1993

(Continued)

*Primary Examiner*—Robert J Canfield
*Assistant Examiner*—Jessie Fonseca
(74) *Attorney, Agent, or Firm*—Dorsey & Whitney LLP

(57) ABSTRACT

A building system is described comprising paired studs (20) for attachment to inside surfaces of facing sheets (10, 11) to provide panel formwork for concrete walls. The studs comprise a head (21) and outwardly extending spaced flanges (22, 23) with inwardly directed teeth (26) and lips (24, 25). Spacer elements (30) are engaged with the recess between the flanges and may be formed from off-cuts of sheet material or as specifically formed elements. The latter are formed from hard plastic and in a preferred embodiment (19) are formed as a rectangular box which can be orientated in alternate directions. The system may include end elements (40), internal top and bottom plates (51), internal corners (90), external corners (100) and a shadow line junction between panels. The invention extends to panels formed with the above system and buildings formed from the panels.

9 Claims, 15 Drawing Sheets

U.S. PATENT DOCUMENTS

| | | | | | |
|---|---|---|---|---|---|
| 3,878,660 | A | | 4/1975 | Jacob | |
| 3,900,996 | A | | 8/1975 | Yohe | |
| 3,916,503 | A | | 11/1975 | Chenevert et al. | |
| 3,992,839 | A | | 11/1976 | La Borde | |
| 4,020,611 | A | | 5/1977 | Amos | |
| 4,057,944 | A | | 11/1977 | Wyatt, Jr. et al. | |
| 4,067,155 | A | | 1/1978 | Ruff et al. | |
| 4,157,641 | A | | 6/1979 | Hasselbacher | |
| 4,254,932 | A | * | 3/1981 | Durbin | 249/42 |
| 4,310,995 | A | | 1/1982 | Hanna | |
| 4,461,133 | A | | 7/1984 | Laroche | |
| 4,548,015 | A | | 10/1985 | Switzgable | |
| 4,698,947 | A | | 10/1987 | McKay | |
| 4,713,921 | A | | 12/1987 | Minialoff et al. | |
| 4,731,968 | A | | 3/1988 | Obino | |
| 4,754,587 | A | | 7/1988 | Glaser | |
| 4,841,707 | A | * | 6/1989 | Novoa | 52/426 |
| 5,007,222 | A | | 4/1991 | Raymond | |
| 5,058,344 | A | | 10/1991 | Biebuyck | |
| 5,058,351 | A | | 10/1991 | Dunstan | |
| 5,233,807 | A | * | 8/1993 | Spera | 52/837 |
| 5,285,615 | A | | 2/1994 | Gilmour | |
| 5,311,718 | A | | 5/1994 | Trousilek | |
| D352,790 | S | * | 11/1994 | Gullblom | D25/121 |
| 5,390,466 | A | | 2/1995 | Johnson et al. | |
| 5,459,970 | A | * | 10/1995 | Kim | 52/424 |
| 5,519,978 | A | | 5/1996 | Sucato et al. | |
| 5,555,698 | A | | 9/1996 | Mandish | |
| 5,605,024 | A | | 2/1997 | Sucato et al. | |
| 5,609,006 | A | | 3/1997 | Boyer | |
| 5,625,989 | A | | 5/1997 | Brubaker et al. | |
| 5,678,381 | A | | 10/1997 | Denadel | |
| 5,809,728 | A | * | 9/1998 | Tremelling | 52/426 |
| 5,819,489 | A | | 10/1998 | McKinney | |
| 5,848,512 | A | | 12/1998 | Conn | |
| 5,896,714 | A | | 4/1999 | Cymbala et al. | |
| 5,992,114 | A | | 11/1999 | Zelinsky et al. | |
| D425,734 | S | * | 5/2000 | Bauer | D6/491 |
| 6,158,190 | A | | 12/2000 | Seng | |
| 6,161,361 | A | | 12/2000 | Ehrenkrantz | |
| 6,250,033 | B1 | * | 6/2001 | Zelinsky | 52/275 |
| 6,314,697 | B1 | * | 11/2001 | Moore, Jr. | 52/426 |
| 6,412,248 | B1 | | 7/2002 | Rudd | |
| 6,668,503 | B2 | * | 12/2003 | Beliveau | 52/426 |
| 6,792,729 | B2 | * | 9/2004 | Beliveau | 52/426 |
| 7,082,732 | B2 | * | 8/2006 | Titishov | 52/426 |
| 2002/0026760 | A1 | * | 3/2002 | Moore, Jr. | 52/309.11 |
| 2002/0092253 | A1 | * | 7/2002 | Beliveau | 52/426 |
| 2002/0124508 | A1 | * | 9/2002 | Dunn et al. | 52/426 |
| 2006/0260240 | A1 | * | 11/2006 | Patz et al. | 52/426 |

FOREIGN PATENT DOCUMENTS

| | | | |
|---|---|---|---|
| AU | 694048 | | 9/1996 |
| AU | 754568 | B2 | 7/1999 |
| FR | 2 587 742 | A1 | 7/1999 |
| GB | 2 081 786 | A | 2/1982 |
| WO | WO 96/27057 | A1 | 9/1996 |

* cited by examiner

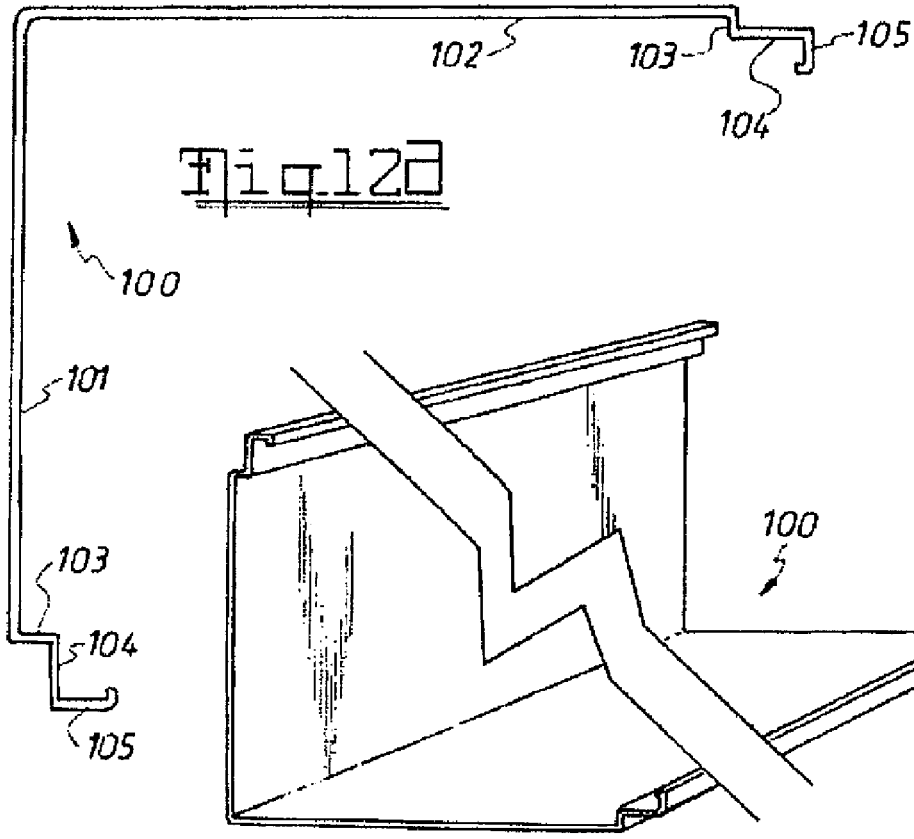
Fig.12a
Fig.12b
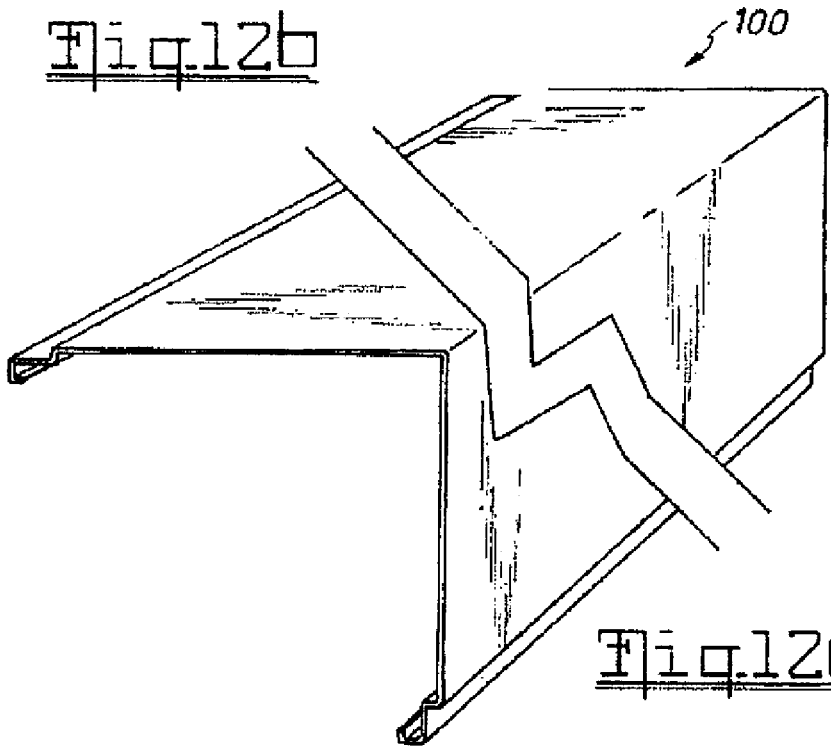
Fig.12c

BUILDING PANELS

FIELD OF THE INVENTION

THIS INVENTION relates to building panels and building systems for forming building panels.

The invention also relates to buildings and construction systems employing the panels.

The invention particularly relates, but is not necessarily limited, to hollow building panels which can be filled with concrete to meet structural strength, thermal-barrier and acoustic-barrier standards, and to buildings and construction systems employing such panels.

BACKGROUND OF THE INVENTION

Many factory form panels are used in the building industry to form walls, roofs, etc for buildings, which are required to meet specific strength, thermal-barrier and acoustic-barrier standards. Examples of commercially successful panels are disclosed in AU-B-26656/92 and AU-B-59414/96, both in the name of Building Solutions Pty Ltd.

While such panels have proven successful, they can always be improved. For example, the need for joiner panels required inventory of two panels for a given height/width/thickness combination. In addition, the panels may not be easily varied in thickness; and do not employ waste materials in their construction: some panels may not be manufactured from a minimum number of basic components.

U.S. Pat. No. 6,161,361 ("Ehrenkrantz") discloses a composite structural member comprising parallel flanges and a plurality of thermally insulative web connectors intermittently disposed between the web connectors. While the description outlines spreading the walls of the flanges apart and allowing them to spring back, the planar finish to abutting surfaces of the flanges and ends would be inadequate for use in concrete pouring into the panel. Considerable pressure is generated by wet concrete flow and settlement. Should a web connector release a flange, the panel would bow resulting in distortion of the outer wall. Other methods to strengthen the bond, such as use of adhesives or arms nesting in recesses in the web connector, are also disclosed. However, these methods add a layer of complexity in use and/or production. Ehrenkrantz is directed to drywall construction wherein loading and strength requirements are not as high as in concrete filled wall production.

U.S. Pat. No. 5,609,006 ("Boyle") discloses a wall stud comprising C-shaped frame members and core elements. The core elements may be located at the top and bottom of the stud, are rigid and accept nails and screws. Additional core elements may be slidably mounted between the top and bottom and are easily adjustable to a desired height to accommodate electrical outlets and switches. The core elements are retained within the frame members by keepers extending inwards from the frame members to ride in slits in the core members. The sliding core members must be secured by punching through side walls of the frame member. This system may also include upper and lower tracks. Boyle is also directed to dry wall construction. The core elements must be slid along the length of the frame members and, in relation to the intermediate core elements, are not self-retaining. They must be punched into position.

U.S. Pat. No. 3,900,996 ("Yohe") discloses a hollow wall structure with wall panels having slits in opposite vertical edges which slidably receive channel shaped margins of elongated fastener strips. Clip elements are also provided to lock a panel in place with a channel shaped wall stud. This system is relatively complex and is designed for demountable hollow wall construction.

WO 96/27057 ("Chicago Metallic") discloses structural elements for walls comprising clamping profiles and connecting pieces slidable in the clamping profiles. Resilient wings of the clamping profiles engage flanges extending from a panel. Connecting pieces may then be used to connect clamping profiles. This is a relatively complex arrangement for use in dry wall formation.

Reference to any prior art in this specification is not, and should not be taken as, an acknowledgment or any form of suggestion that this prior art forms part of the common general knowledge in any country.

SUMMARY OF THE INVENTION

Throughout this specification, unless the context requires otherwise, the word "comprise", or variations such as "comprises" or "comprising", will be understood to imply the inclusion of a stated element or integer or group of elements or integers but not the exclusion of any other element or integer or group of elements or integers.

One embodiment of the present invention may provide a building panel which can be manufactured in a range of heights, widths and/or thicknesses from a minimum number of different components.

A preferred embodiment may also provide such a panel which has limited thermal bridging, for improved thermal-barrier characteristics.

The preferred embodiment may provide a panel which minimises corrosion by separating dissimilar metals.

The panel may use off-cuts from the facing sheets and for spacer elements in the panel to minimise waste.

One advantage of the preferred embodiment may provide panels which enable simplified stock ordering/reduced material inventories/simplified erection in building systems employing the panels.

In a first aspect, the invention resides in a stud for use in panel form work for solid filled walls, the stud comprising a head adapted to be bonded and/or fastened to an inner face of an associated facing sheet, a pair of spaced, opposed flanges formed integrally with and extending away from the head, each flange having two or more inwardly directed teeth, wherein the passage of a suitably dimensioned spacer element into a recess formed by the flanges causes the inwardly directed teeth to engage the spacer element.

The teeth may be barbed.

The flanges are preferably resiliently deformable outwardly by passage of the spacer element to thereby engage the spacer element by compressive contact with the teeth. In a preferred embodiment, the stud has a cross-sectional configuration that is substantially T-shaped.

The teeth may extend longitudinally along the corresponding flange and preferably three to ten teeth are arranged on each flange.

An out-turned terminal lip on each of the flanges may be provided to lead into the recess.

The stud can be formed as an extrusion from aluminium, polyethylene and polyvinyl chloride. Any suitable rigid plastic may be used.

In a further aspect, the invention may reside in a building system for use in panel form work for solid filled walls, the building system comprising at least one pair of the studs as described above and one or more spacer members.

The spacer elements may be formed from medium-density fibreboard, high-density fibreboard, fibre cement sheeting or aluminium sheeting. Alternatively, the one or more spacer elements may be formed from polyethylene and polyvinyl chloride or other suitable synthetic material, preferably polymeric and a rigid plastic.

Spacer elements may be adapted for use in each of two different directions or orientations to provide alternative spacings between a pair of aligned studs.

The spacer elements may be formed with a rectangular box-like shape, having one or more tongues extending from each side, the tongues dimensioned to locate in the recess of the stud.

The spacer elements may have two spaced tongues on each side of the rectangular box.

An aperture may be formed in the spacer element and dimensioned to allow passage of one or both of reinforcing materials and utility services such as plumbing, electrical lines and communication lines.

The spacer elements can be formed in modular lengths of mx 100 mm long where m is any suitable number.

The building system may further comprise end elements having a channel to receive a bottom, side or top edge of a facing sheet.

The end elements may have flanges joined by a web to form a channel adapted to receive the edge of a facing sheet.

One or more end elements may further comprise an L-shaped flange forming a plate channel to receive outwardly extending flanges of a top or bottom plate member.

The building system may further include top and/or bottom plate members.

The top and bottom plate members may be formed as substantially planar members having outwardly extending flanges adapted to engage a corresponding plate channel of an edge element.

The top and bottom plate members may be formed in modular lengths of n×100 mm wherein n is any suitable number.

The top and bottom plate members may be formed from metal, such as aluminium, or a suitable polymeric synthetic material such as polyethylene or polyvinyl chloride.

The end elements may further comprise an additional channel adjacent to and at right angles to the plate channel and adapted to receive an infill member.

The building system may further comprise infill members formed as a substantially planar aluminium extrusion.

The infill members may have a weather fin extending longitudinally and outwardly from its planar surface to provide a weatherproof barrier particularly when used in window construction.

An end element may further comprise a longitudinal extension lip adapted to provide a shadow line when used at a bottom edge of an outer facing sheet of all upper storey panel.

The building system may further comprise one or more joiner elements.

The joiner elements may be substantially L-shaped comprising a body and a flange with a terminal lip.

The joiner elements may be aluminium extrusions formed in modular lengths of approximately 100 mm or multiples thereof.

The building system may further comprise an internal corner for connecting two angled adjacent inner facing sheets, wherein the internal corner is substantially W-shaped with webs at around 90° angle and terminated by flanges having an associated lip.

The building system may further comprise an external corner adapted to join two angled outer facing sheets.

The external corner may have webs at slightly less than 90° and preferably around 89°, each web terminated by an inward flange.

The building system may further comprise one or more edge form rebates configured with primary flanges connected by a first web to form a channel adapted to receive an edge of a facing sheet, a secondary flange perpendicular to the first web and supporting a second web having a lip.

In a third aspect, the invention may reside in a building panel for use in the construction of concrete filled walls and the like, the building panel including spaced apart first and second facing sheets and at least two pairs of studs according to the above description, one stud of each pair being fixed to an inner face of one of the first and second facing sheets and aligned with the other stud of the pair fixed to an inner face of the other of the first and second facing sheets and at least one spacer element interconnecting the one and other studs of each pair and arranged so that voids in the panel are adapted to be filled with concrete and/or structural building elements.

The facing sheets may be formed of fire-resistant or fire-retardant materials such as MDF, HDF, fibre cement sheeting, aluminium sheeting, plastic sheeting and high-density polystyrene foam.

The spacer elements may be formed from the facing sheet material.

The spacer elements may be formed from polyethylene or other suitable polymeric material.

The spacer elements may be adapted for use in each of two different directions or orientations to provide alternative spacings between a pair of aligned studs.

End elements may be positioned on at least one edge of a facing sheet.

The building panel may further comprise one or more top plate modules and/or bottom plate modules, preferably interconnecting end elements on the first and second facing sheets.

The building panel may also comprise an infill member positioned between end elements lining a recess in the panel.

The end elements and corresponding infill members may line a window aperture. One or more infill members may have a weather fin.

The building panel may further comprise concrete poured into the void.

In a fourth aspect, the invention may reside in a building structure comprising two or more panels as described above and further comprising a longitudinal extension lip forming a shadow line between an upper and lower panel.

In a fifth aspect, the invention may reside in a building structure comprising two or more panels as described above and further comprising a construction joint between two adjacent panels.

In a sixth aspect, the invention may reside in a building structure comprising panels as described above with at least two panels joined at a corner and including an internal corner and external corner.

Longitudinal or angled reinforcing members may be positioned or pass between the internal and external corners.

In a seventh aspect, the present invention resides in a building panel for use in the construction of walls and the like, including:

spaced apart first and second facing sheets;

at least two pairs of studs, one stud of each pair being fixed to an inner face of one of the first and second facing sheets and aligned with the other stud of the pair fixed to an inner face of the other of the first and second facing sheets;

at least one spacer element interconnecting the one and other studs of each pair; and arranged that voids in the panel are adapted to be filled with concrete and/or structural building elements.

Preferably, the facing sheets are formed of fire-resistant, or fire-retardant materials, such as MDF, HDF, fibre-cement sheeting, aluminium sheeting, plastic sheeting or the like. Facing sheets may have a pre-finished outer face, or be adapted to be coated eg. by paint, plaster or other suitable coatings or finishes.

Preferably, the pairs of studs are provided at modular distances of n or 2n (where n is typically 82 mm). The actual spacing can be varied to suit a particular intended installation.

Preferably, the studs are of modular length eg. nx millimetres (where x is typically 100 mm).

Preferably, the studs are terminated 0-100 mm, more preferably 0-50 mm from the bottom of the facing sheets, and 0-300 mm, more preferably 200-300 mm from the top of the facing sheets.

Preferably, the studs are bonded to the facing sheets by suitable adhesives, but may be fixed by fasteners or other suitable fixing means.

Preferably, the studs are extruded from aluminium, plastics material (including fibre-reinforced plastic materials) or other suitable materials.

Preferably, the spacer elements are thermally insulating to counter thermal bridging in the panel.

Preferably, the spacer elements are formed from off-cuts of the facing sheet material.

Preferably, the spacer elements are mx mm long (where x is typically 100 mm) and are spaced nx mm apart (where x is typically 100 mm).

Preferably, vertical and/or horizontal reinforcing elements eg. reinforcing bars, can be inserted into, and extend from, the floors before the panels are filled with concrete.

Preferably, a pair of end elements, having a channel to receive a bottom or top edge of a facing sheet, are provided along the top and bottom of the panels to enable the panel to be fixed to panels, or other building structure(s) above and below it.

Preferably, a pair of end elements are provided along the side of the panel for fixing to a similar panel at a junction.

Preferably, joiner elements, preferably the same material as the studs, and preferably of modular length of nx mm (where x is typically 100 mm) interconnect the adjacent studs of the adjacent panels together. A length of 300 mm may be particularly suitable.

Preferably, a top plate or bottom plate interconnects the end elements at the top, and bottom, of the panel, respectively, to restrain the facing sheets from bowing or deforming.

Preferably, internal and external corners interconnect the respective facing sheets of adjacent panels at the corner.

In an eighth aspect, the present invention resides in a construction system employing the panels hereinbefore described, the construction system providing a building structure which meets/exceeds strength, thermal-barrier and/or acoustic-barrier standards.

In ninth and tenth aspects, respectively, the present invention resides in a building structure incorporating the panels of the first aspect and constructed employing the construction system of the second aspect.

In an eleventh aspect, the invention may reside in versatile spacer element able to be aligned in two different orientations to provide alternative spacings and as described above.

In a twelfth aspect, the invention may reside in an end element for location on the edge of a panel and substantially as described above.

In a thirteenth aspect, the invention may reside in end elements and modular top/bottom plates for interconnecting the end elements, substantially as described above.

In a fourteenth aspect, the invention may reside in a bottom end element for a facing sheet and top end element for an adjoining lower facing sheet, wherein the two end elements co-operate to provide a shadow line, as described above.

Other aspects of the present invention relating to components of the building system will become apparent from the following description.

BRIEF DESCRIPTION OF THE DRAWINGS

In order to provide a better understanding of the present invention, preferred embodiments will be described in detail, by way of example only, with reference to the accompanying drawings in which:

FIGS. 12(*a*) to (*c*) are respective views of an external corner;

DETAILED DESCRIPTION OF THE DRAWINGS

Figure 1:
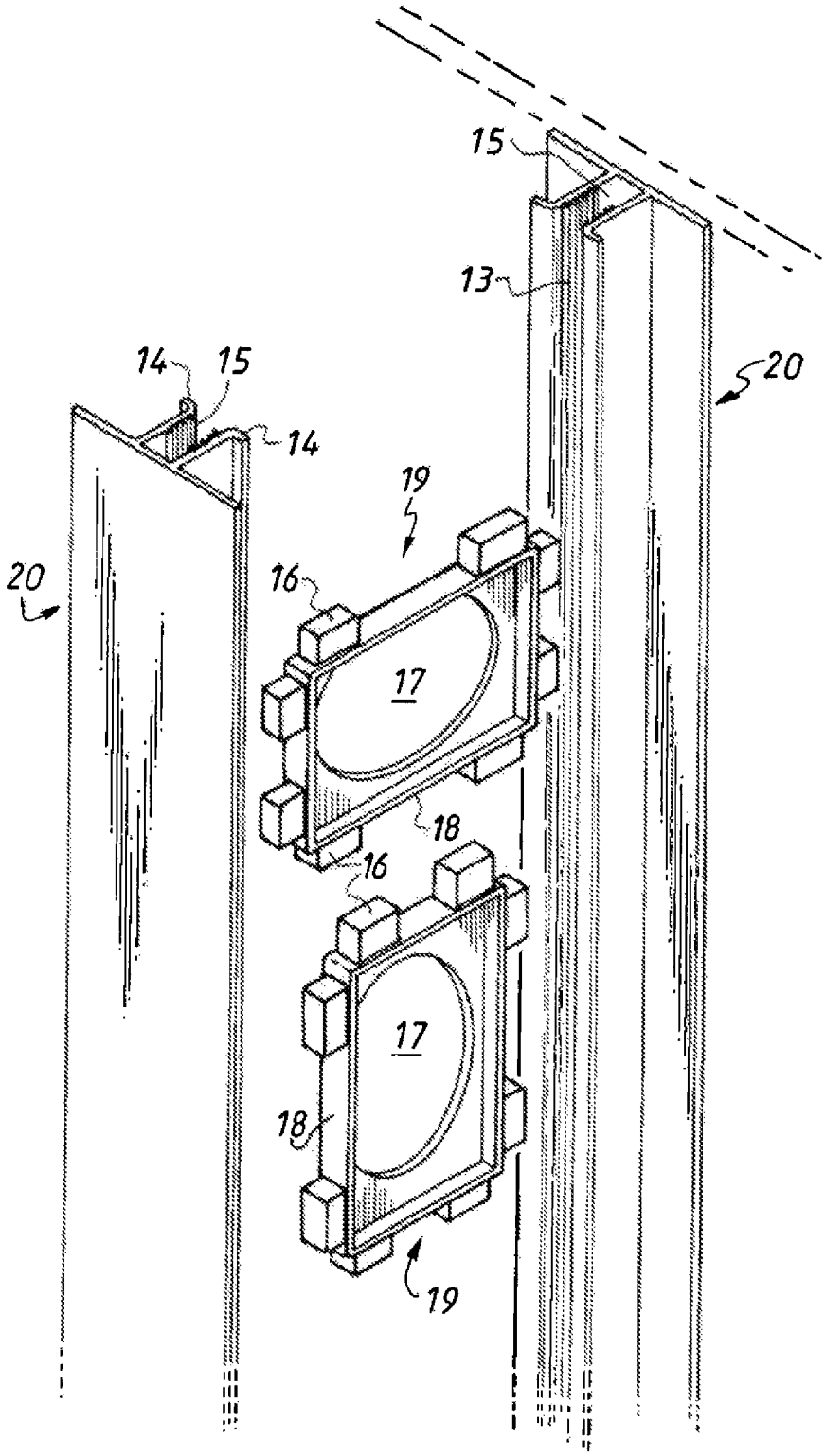
FIG. 1 is an exploded view of two studs and alternative alignment of a synthetic spacer element.

FIG. 1 shows an exploded view of the present invention in which a pair of studs 20 are aligned for interconnection by a spacer element 19 shown in alternative orientation.

The studs are co-extensive in length but this may be varied to provide different heights of support on opposed sheets.

Each spacer element 19 is formed as a rectangular, box-like structure with a peripheral flange 18 and a central aperture 17. The aperture is dimensioned to receive and support service lines such as telephone, electrical and water services. Reinforcing bars may also be positioned through the apertures.

In the event that the studs are formed from aluminium or other metal, it is important to avoid contact between the stud and steel reinforcing bars. Contact between dissimilar metals may be lead to accelerated corrosion of one or both.

Each side of the spacer element has two outwardly extending tongues 16. The tongues 16 are dimensioned to be slightly larger than the recesses 15 in the studs. The tongues may therefore be aligned with the lead-in path formed by outwardly turned lips 14. Progression of the tongues through the lips causes separation of the flanges and subsequent alignment of the tongue with teeth 13 in the recesses 15. Further pressure, preferably by impact, will cause full seating of the tongue with the teeth compressively engaging an outer surface of the tongues. Pressure localisation by the teeth causes high frictional resistance to withdrawal of the tongue. Representative dimensions of the recess are 6 mm wide×15 mm deep. The tongue may be 6 mm wide, giving a relative over dimension to the teeth and 12 mm deep.

The present invention therefore allows assembly on site. The stud and spacer elements may be joined and then fitted to facing sheets. Alternatively, the studs may be positioned on the facing sheets by adhesive or fixtures, such as screws, and then joined by addition of the spacer elements. Facing sheets of a formed panel may be supported at an outside edge by location of studs in appropriate position.

As the rectangular construction of the spacer element provides a different length and height, the spacer element may be rotated through 90° to provide an alternative spacing by different orientation. This versatility aids in reducing the inventory required by a builder. Two preferred dimensions may be formed in the spacers and may, for example, be 67 mm high and 87 mm long giving walls of 115 mm and 135 mm, respectively. In a larger size, the spacer may be 115 mm×135 mm giving walls of 150 mm and 200 mm.

The presence of the spaced tongues also provides an alternative guide for reinforcing material, such as steel bars, as they may be routed over the top of the spacer element while still shielded from contact with the stud by presence of bilateral tongues.

The spacer element may be formed with two or more apertures. Each side may have three or more tongues.

As shown in FIGS. 2, 4, 5 and 9(*a*) to (*n*), each panel 10 has a pair of facing sheets 11, 12, typically 6.0 mm thick, of suitable material (eg. MDF, fibre-cement), which is preferably fire-resistant, or at least fire-retardant.

The facing sheets are 11, 12 cut to the desired height of panel 10 (eg. 2.4-3.0 m) and to the desired width (eg. in the range of 132 to 1200 mm as shown in FIGS. 9(*a*) to (*n*)).

Preferably, the studs 20 are spaced at modular intervals of n or 2n, wherein n=82 mm in the example shown in FIGS. 9(*a*) to (*n*), although this spacing may vary.

Preferably, in the panels of 132 mm and 215 mm width, the spacing of the studs is at the n modular spacing. For the panels of 214 mm, 379 mm, 543 mm, 707 mm, 831 mm, 1036 mm and 1200 mm width, the spacing of the studs is at 2n modular spacing. For the remaining panels, the pairs of studs 20 at the sides are at n modular spacing and the intermediate pairs of studs 20 are at 2n modular spacing (eg. 544 mm panel has studs 20 at n/2n/2n/n modular spacings). To achieve any desired panel size, the outside studs can be positioned between 1n-2n.

Figure 10A:
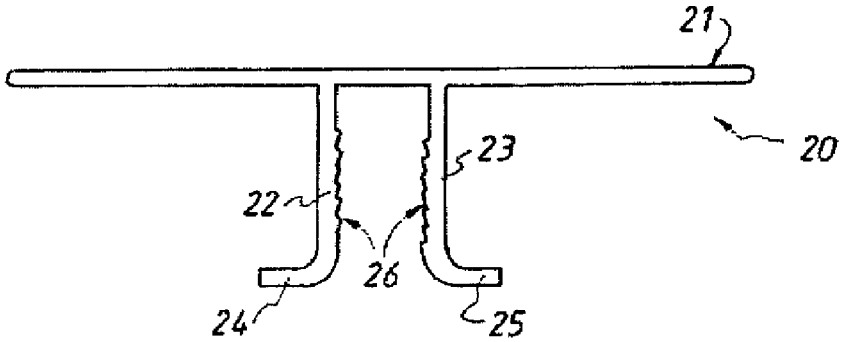
FIGS. 10(*a*) to (*c*) are respective views of a stud of the invention.
Figure 10B:
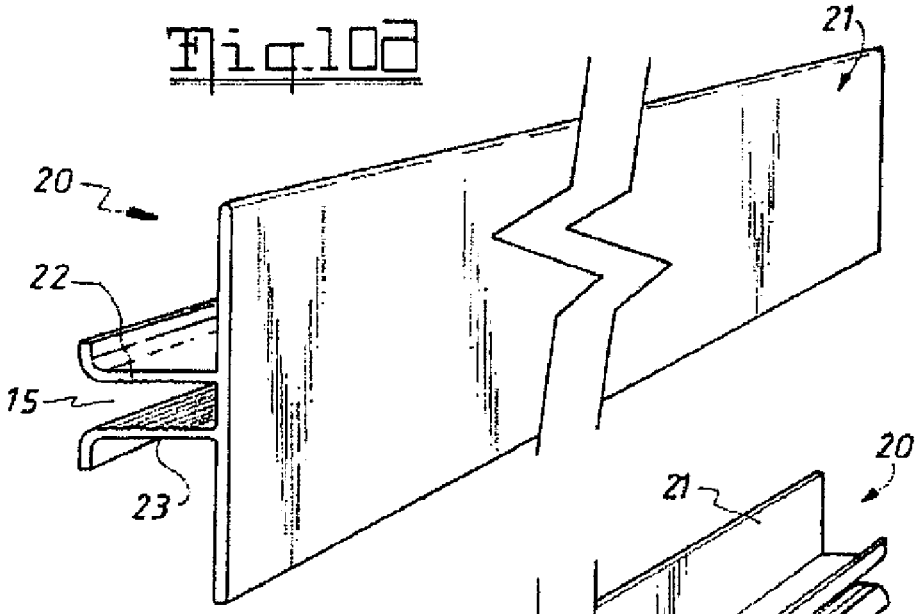
Figure 10C:
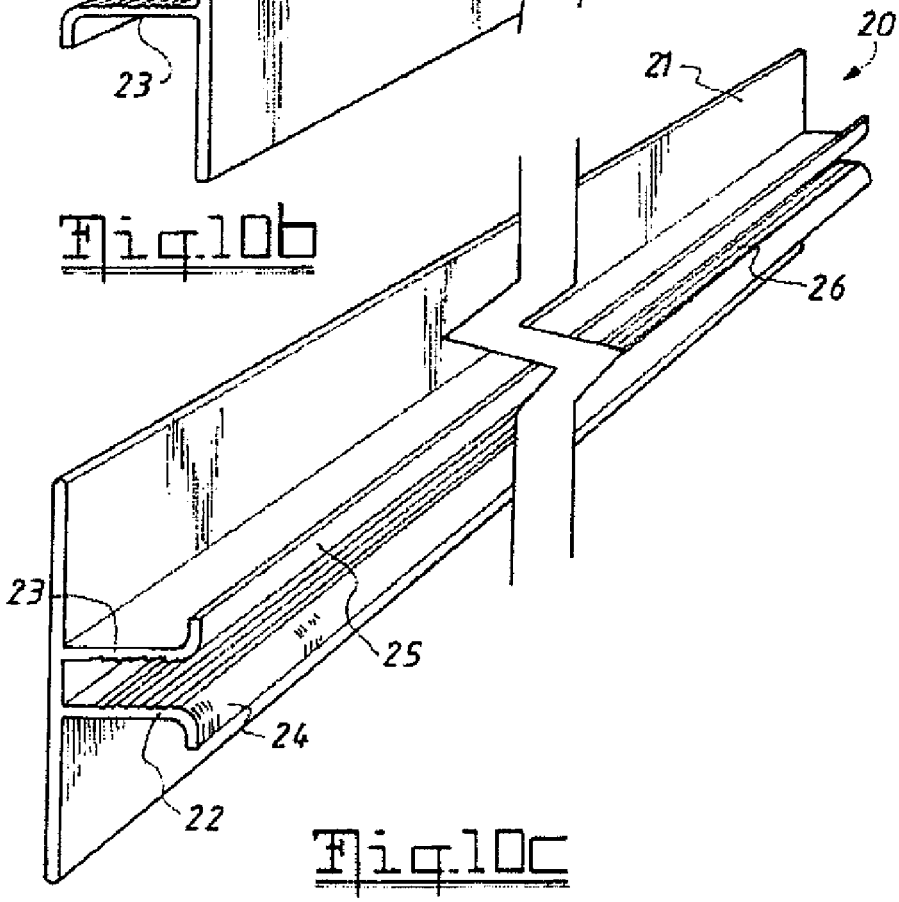

As shown in FIGS. 1 to 8, and more particularly FIGS. 1 and 10(*a*) to (*c*), the studs 20 are of a modified "T-shape" end view. The studs 20 are preferably extruded in aluminium (or other suitable metal), plastic material (including fibre-reinforced plastics) or any other suitable material.

Each stud 20 has a head 21 adapted to be bonded (by adhesives) and/or fastened (by rivets, screws, other suitable fasteners) to the inner face of its associated facing sheet 11, 12. A "bifurcated leg" to the T-shape is provided by a pair of flanges 22, 23 formed integrally with the head 21 and having out-turned "leading" lips 24, 25. The flanges form recess 15. Flanges 22, 23 having inwardly directed teeth 26 adapted to engage spacer elements 30, 37. The teeth 22, 23 are formed as a plurality of longitudinal parallel ridges. At least two are located on each flange. Preferably six or more are appropriate. The teeth may be "barbed" or formed with a gradual approach slope (ie. in terms of the spacer element) and sharp trailing slope to provide a sharp ridge better adapted to engage the spacer element surface. This effect may be enhanced by the spacer element being slightly wider than the recess 15 leading to outward deformation of the flanges 22, 23 and resilient "spring back" causing compression of the spacer element between the teeth.

The studs 20 preferably terminate 50-100 mm above the bottom edge of the facing sheets 11, 12 and 100-300 mm below the top edges of the facing sheets 11, 12. (Preferably, the studs are multiples of 100 mm in length.)

The flexible top and bottom edge distances require less stock to be held as a particular length will enable panels of multiple heights to be manufactured.

Studs may be manufactured to have the extrusion on one side of the assembly extend beyond the length of the other side avoiding the need to cut studs and generate waste. This allows a facing sheet on one side to be supported above the height of the opposite facing sheet providing edge framework for a concrete slab.

As the heads 21 of the outer studs 20 may extend to the side edges of the facing sheets 11, 12, the side edges are protected against damage during manufacturing, transportation and erection of the panels 10.

Figure 2:
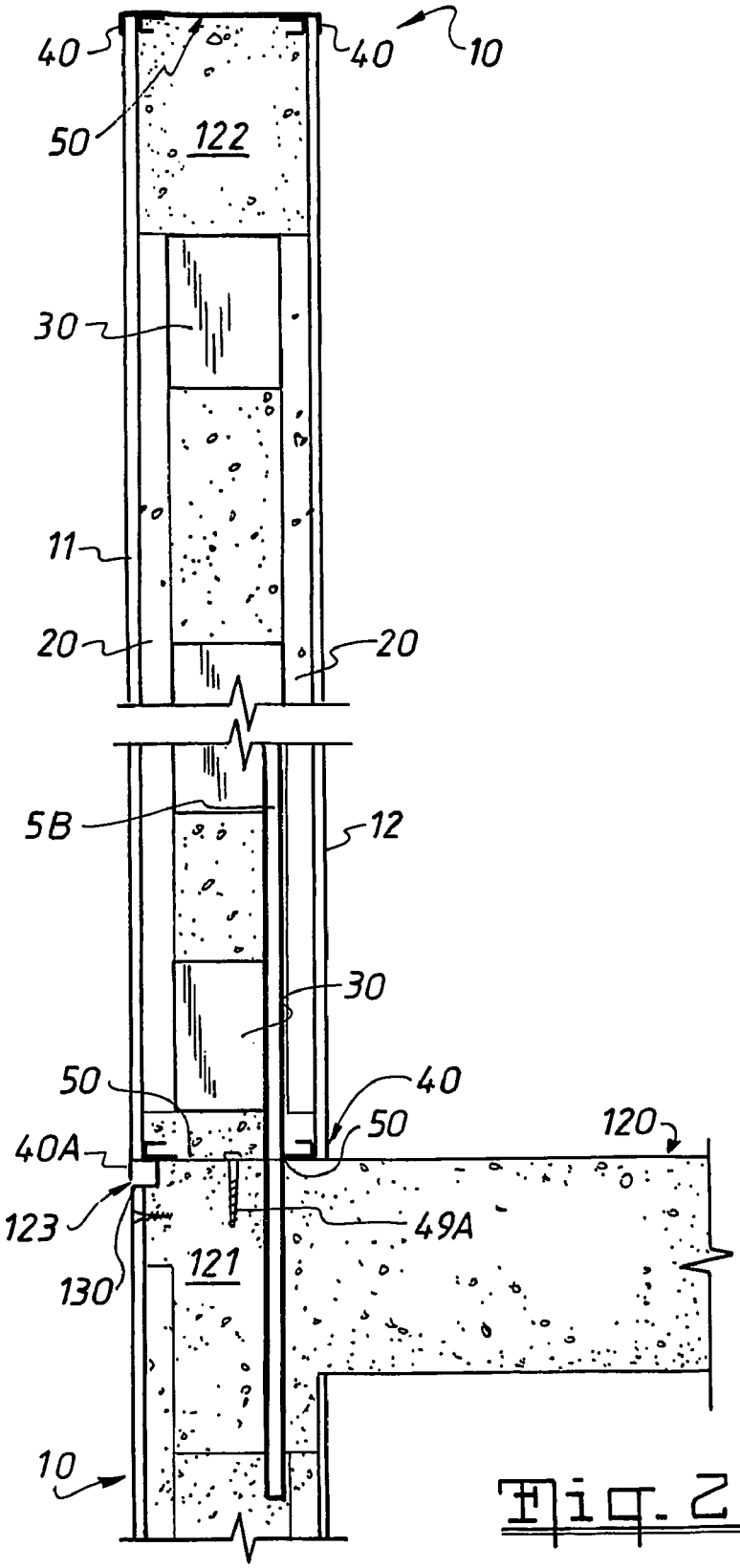
FIG. 2 is a typical sectional end view of walls and a floor using the panels of the present invention.

In an alternative embodiment, the spacer elements 30 are off-cuts from the material sheets from which the facing sheets 11, 12 are cut. They may also comprise purpose made plastic spacers. As shown in FIG. 2, they are preferably 100 mm (or a multiple thereof) long and are spaced apart, preferably at multiples of 100 mm to 250 mm to allow structural reinforcing steel to be passed therebetween and to also allow concrete to flow between the vertical cavities in the panels separated by the space elements 30.

Figure 5:
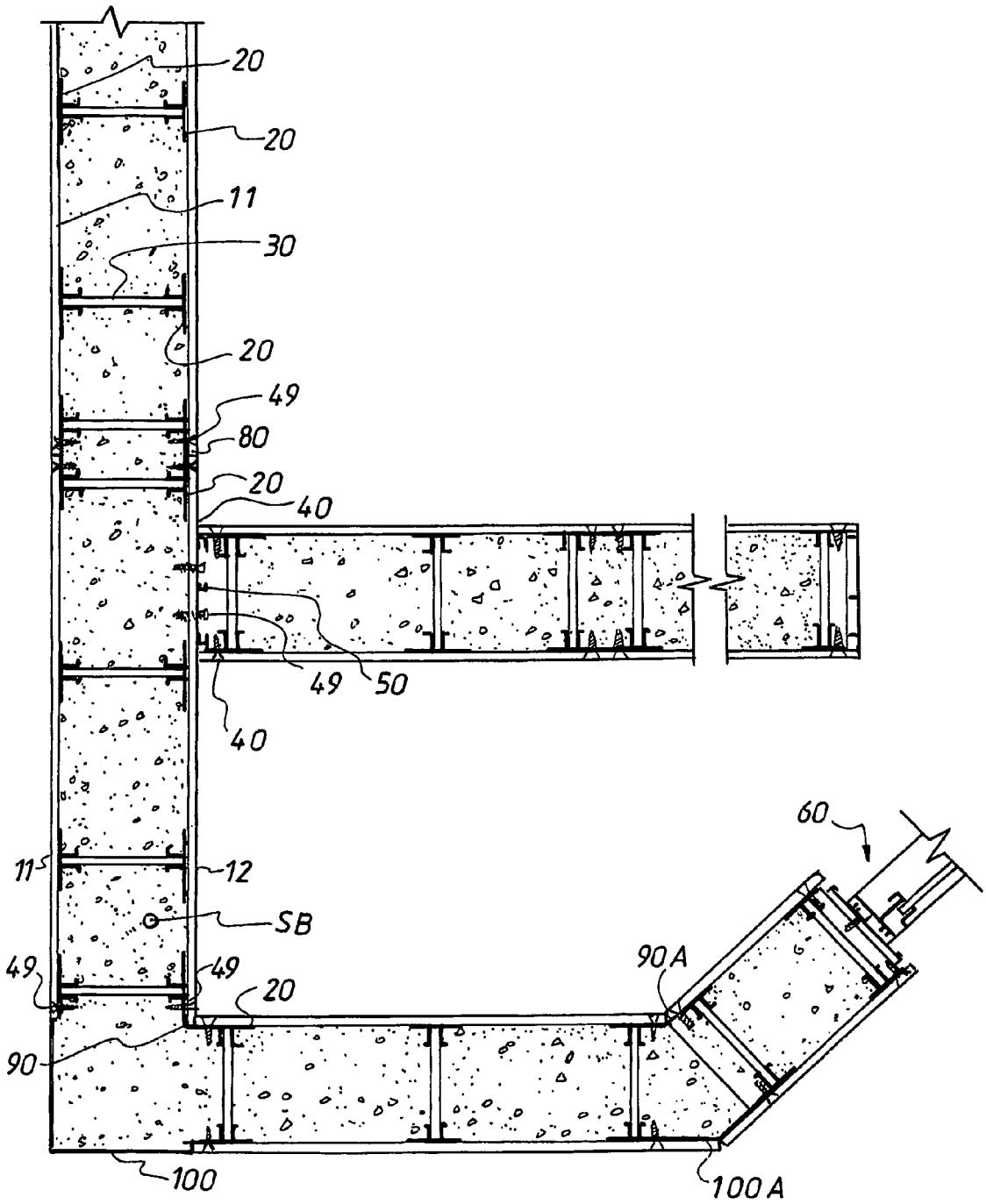
FIG. 5 is a top sectional view of a number of walls constructed using the panels.

As shown in FIGS. 2 and 5, vertical starter bars SB can extend into the vertical cavities in the panels 10.

Figure 3:
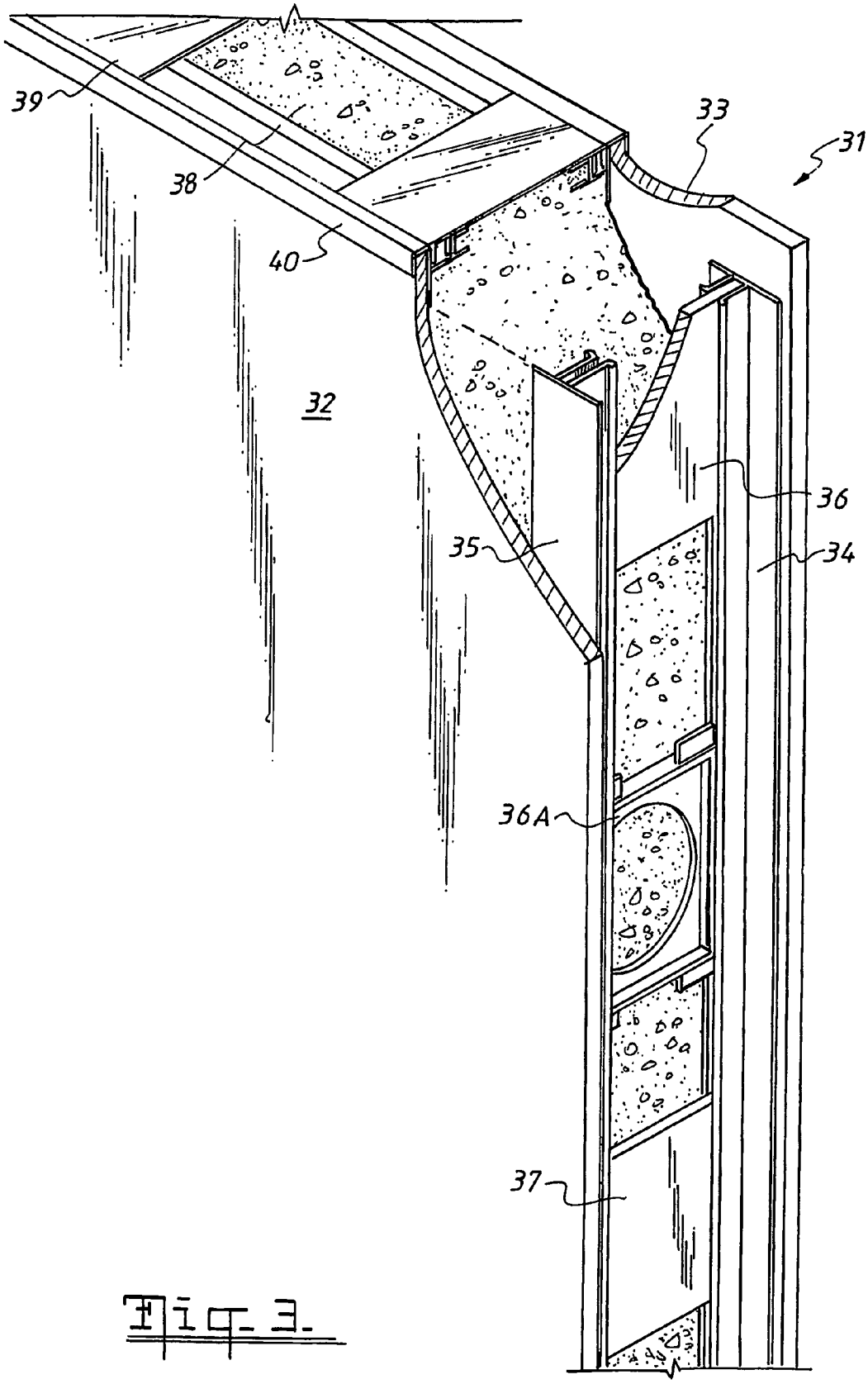
FIG. 3 is a cutaway perspective view of a panel with concrete positioned internally.

FIG. 3 shows a cutaway perspective view of a panel 31 formed by facing sheets 32, 33, studs 34, 35 and spacer elements 36, 37. The top spacer element 36 is a cutaway schematic view of a formed spacer and seen in full at 37. A spacer could be formed according to a configuration with a dorsal, open recess to allow easy location of reinforcing elements. The bottom spacer 37 is formed from the alternative option of off-cuts of panel material.

Concrete 38 has been poured into the panel and flows between the spacer elements 36, 37 providing high strength lateral continuity while also enveloping the spacer element to minimise thermal and acoustic bridging.

The studs 34, 35 are shown as extending to just below the top of the panels 32, 33 but, as is discussed elsewhere, this could be a wider margin. A module of top plate 39 is also apparent. The top plate may be formed and positioned in modular spaced sections to facilitate easy pouring of wet concrete while simultaneously providing bracing of the facing sheets. Horizontal bearers may be positioned on the top plates before the concrete is poured as the panels, if constructed to appropriate strength, will support them. This can be of considerable assistance in construction.

Figure 4:
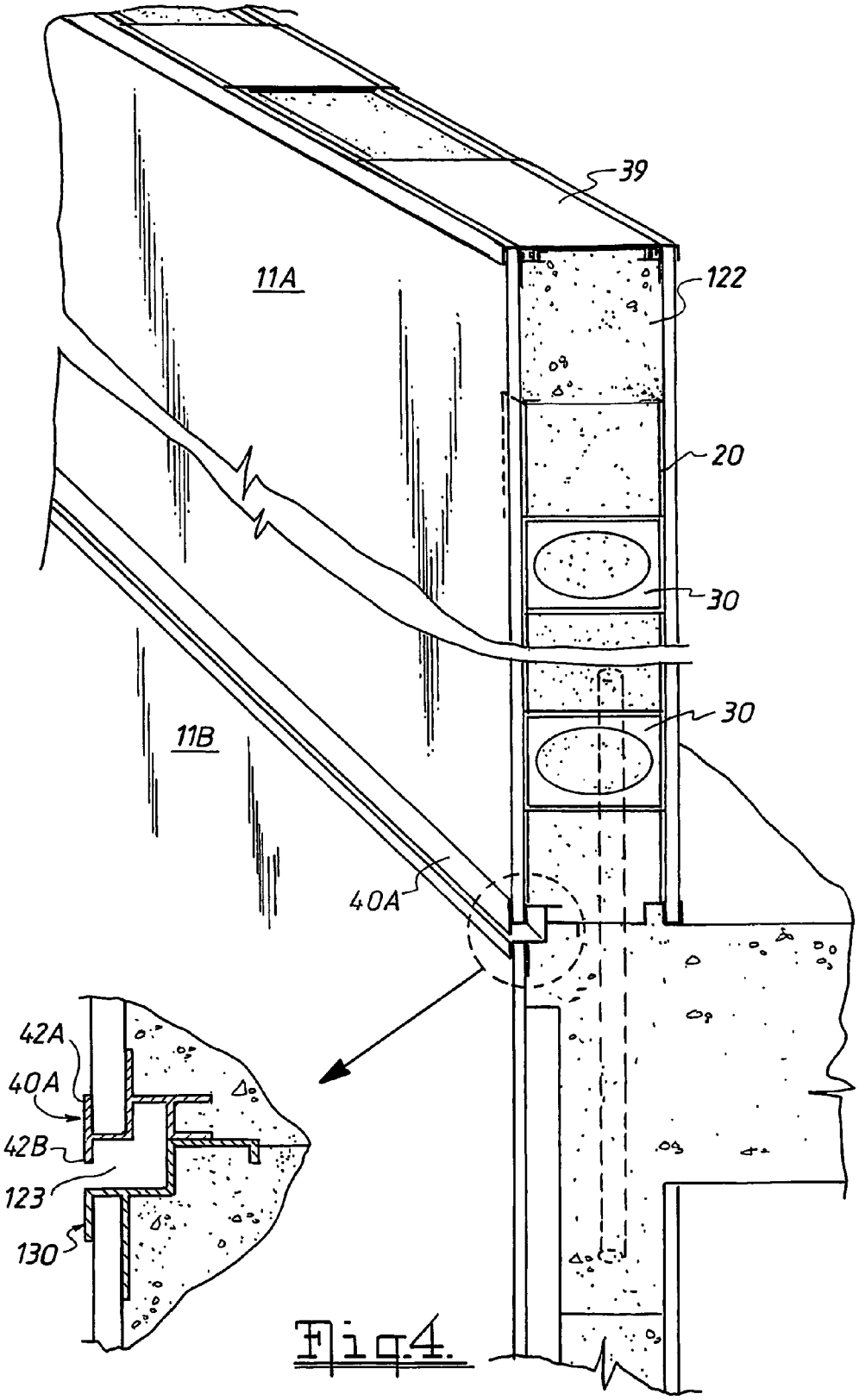
FIG. 4 is a cutaway perspective view of the arrangement of FIG. 1.

FIG. 4 shows a perspective view of the arrangement of FIG. 2. The bottom element 40A sits over the rebate 123 to form a shadow line which effectively masks any discontinuity between outer facing sheets 11A, 11B of the upper and lower panels, respectively. Top plate modules 39 are also apparent and shown as spaced along the top panel to allow effective pouring of concrete.

Studs 20 are terminated below the upper edge of the facing sheets allowing continuous formation of the bond beam 122.

Spacer elements 30 are positioned as previously described.

Figure 15A:
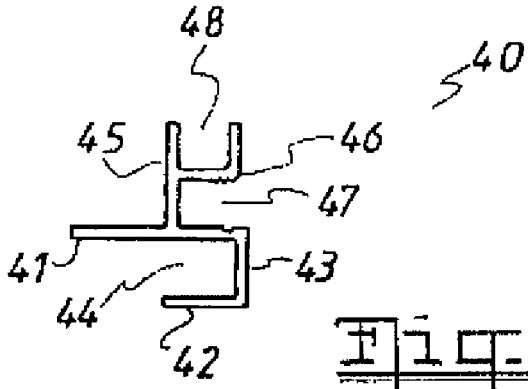
FIGS. 15(*a*) to (*c*) are respective views of a top or bottom end element.
Figure 15B:
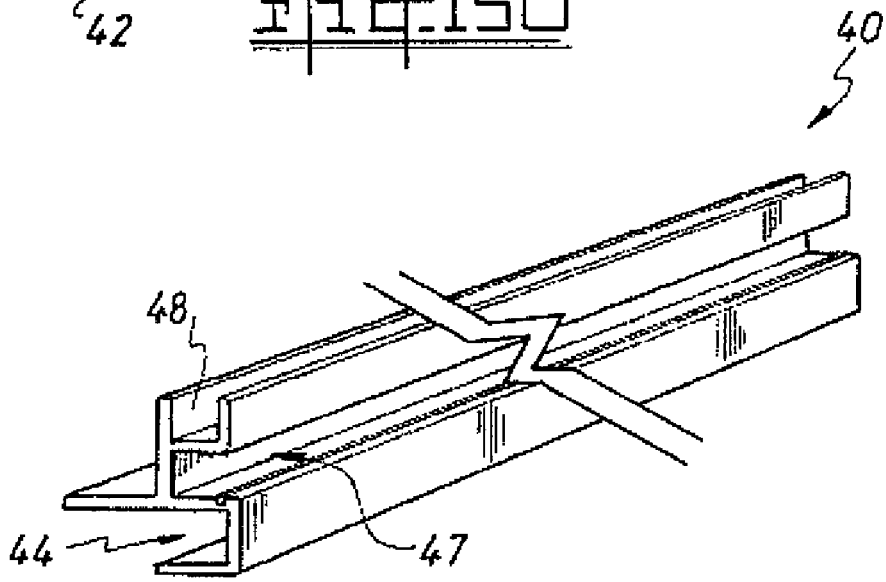
Figure 15C:
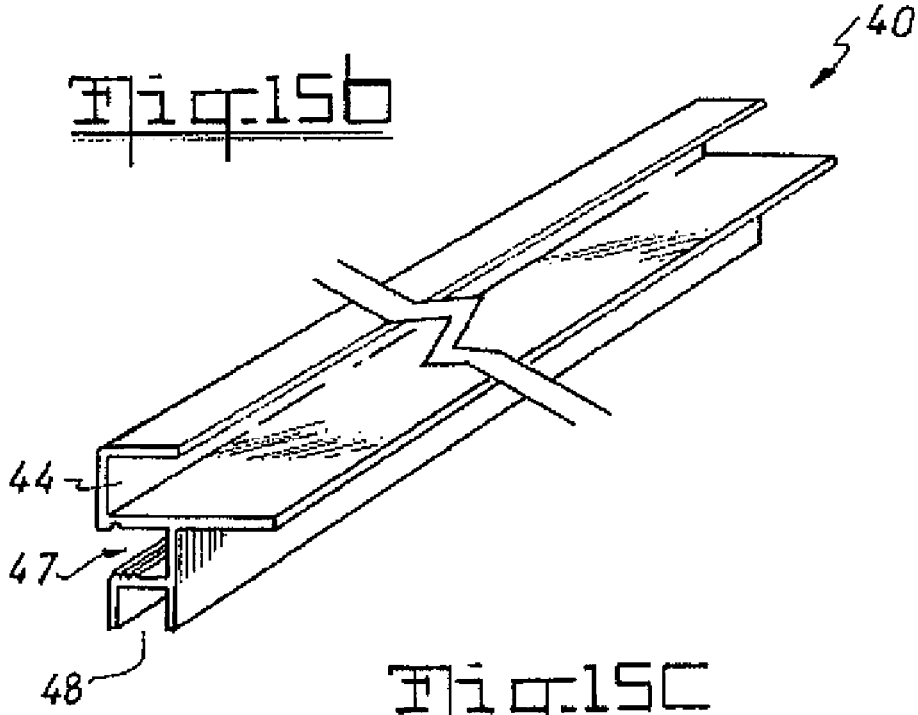
Figure 16A:
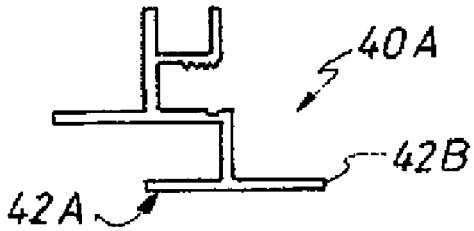
FIGS. 16(*a*) to (*c*) are similar views of a bottom end element with a lip.
Figure 16B:
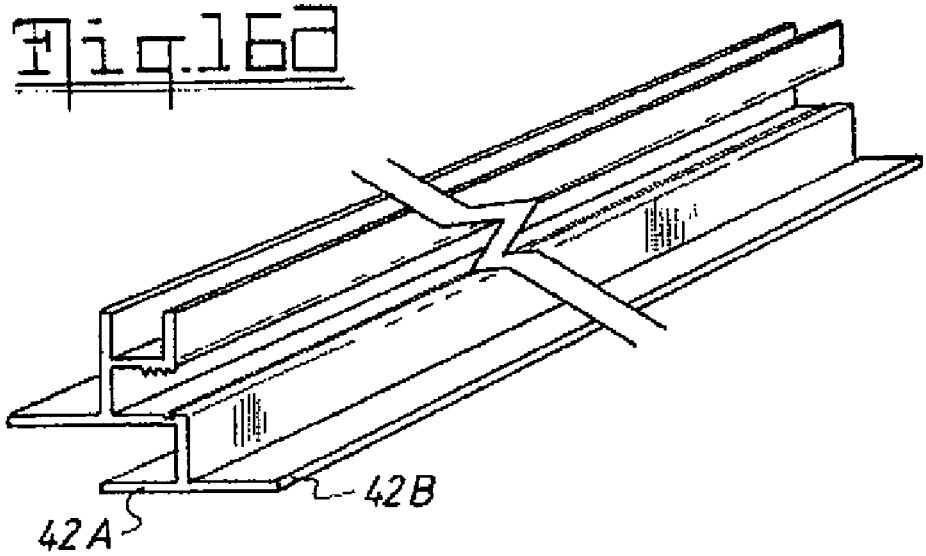
Figure 16C:
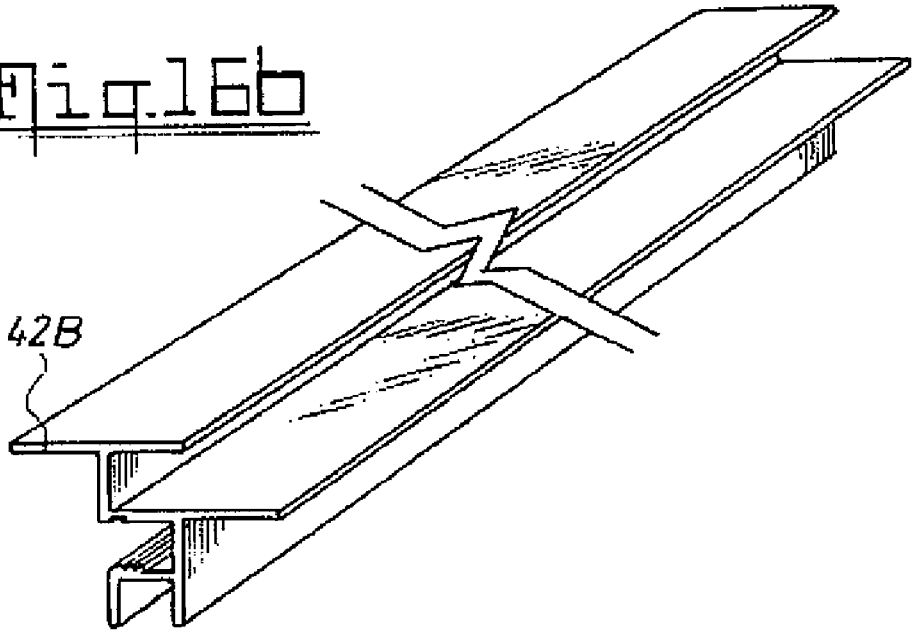

End elements 40, shown in more details in FIGS. 15(*a*) to (*c*) are provided along the top and bottom edge of the facing sheets 11, 12 of FIG. 2. The end elements 40 have face flanges 41, 42 joined by a web 43 to form a channel 44 operable to receive the edge of a facing sheet 11, 12. A web 45 extends from flange 41 and has an L-shape flange 46; the flange 41, web 45 and L-shape flange 46 forming a channel 47 to receive one end of a top or bottom plate 50.

Figure 14A:
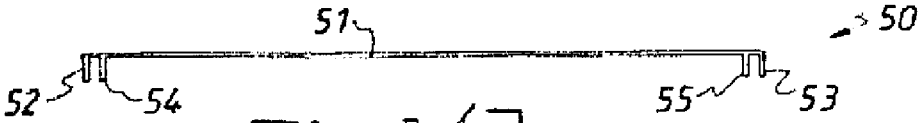
FIGS. 14(*a*) to (*c*) are respective views of a top plate or bottom plate which may also act as joiners or end closers.
Figure 14B:
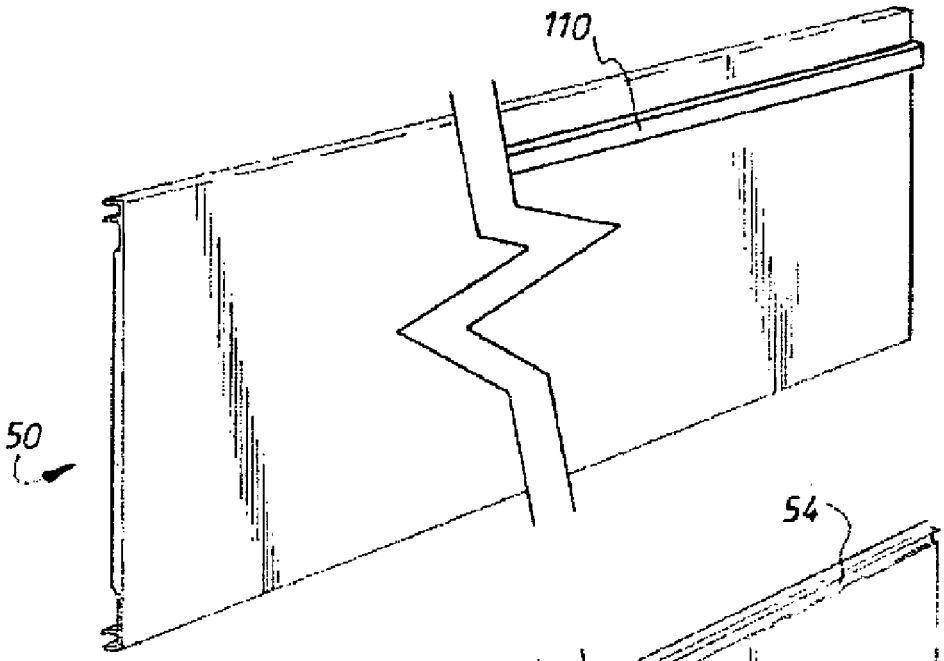
Figure 14C:
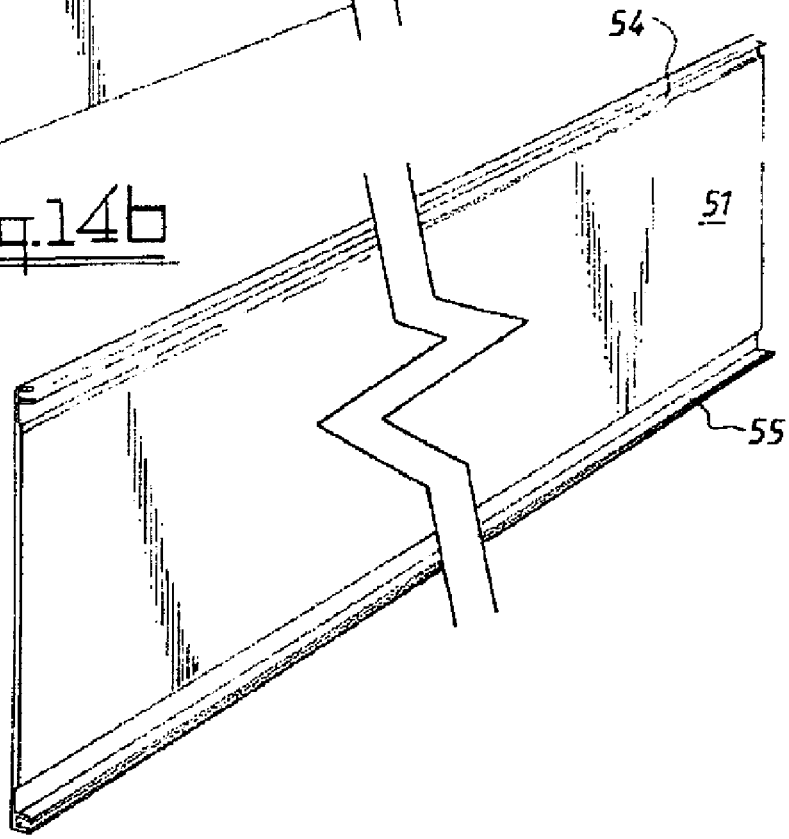

Referring to FIGS. 14(*a*) to (*c*), each top or bottom plate 50 has a substantially planar body 51 with down turned lip flanges 52, 53 along the sides of the body 51. Flanges 54, 55 extend perpendicularly from the body, and as shown in FIG. 2, the flanges 54, 55 are adaptedly engaged in the channels 47 of the end elements 40.

Preferably, the top and bottom plates are extruded from aluminium, as are the end elements 40; but while the end elements 40 extend the full length of the facing sheets 11, 12, the top and bottom plates 50 are preferably cut to modular lengths eg. 100 mm or multiples thereof.

Also shown in FIG. 14 is section of a weather fin 110 which arises from the planar surface and is adapted to provide easy sealing against a structure such as a window assembly. A similar arrangement may be provided on infill material formed as a planar extrusion without flanges. The fin may be narrower or wider and as high as required. It may also be positioned in any suitable front to rear location.

Figure 7:
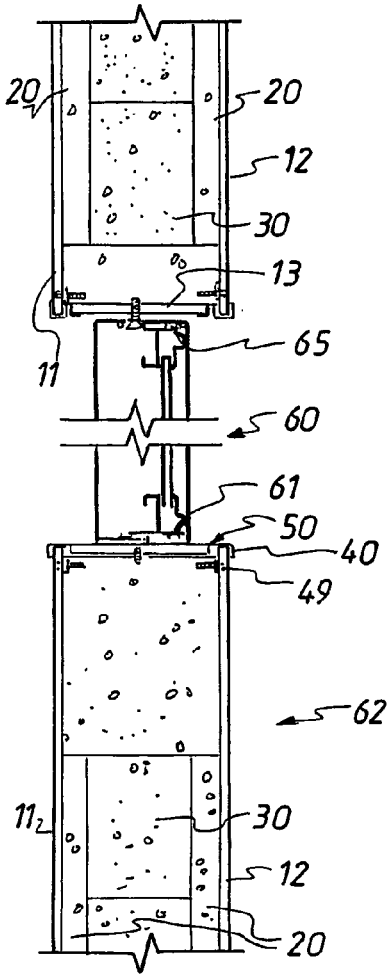
FIGS. 7 and 8 are respective side and top sectional views of a window installation in one of the panels.
Figure 8:
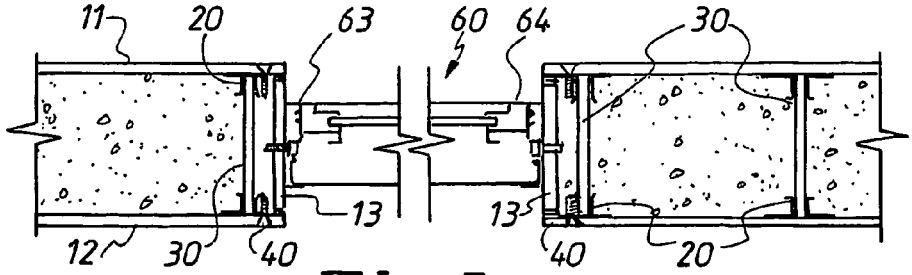
Figure 9A:
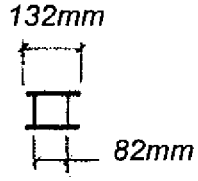
FIGS. 9(*a*) to (*n*) are respective top plan views of the range of panels.
Figure 9B:
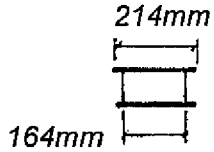
Figure 9C:
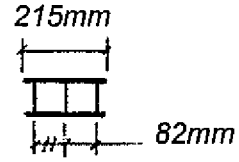
Figure 9D:
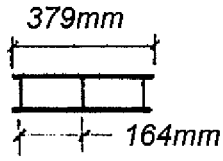
Figure 9E:
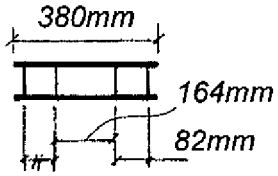
Figure 9F:
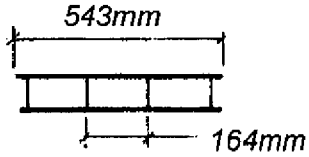
Figure 9G:
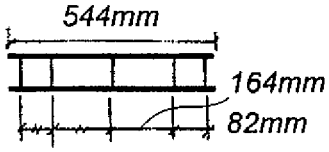
Figure 9H:
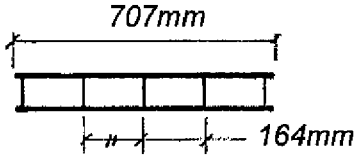
Figure 9I:
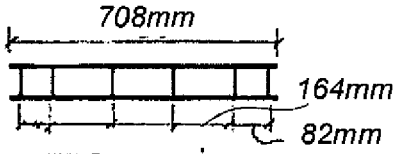
Figure 9J:
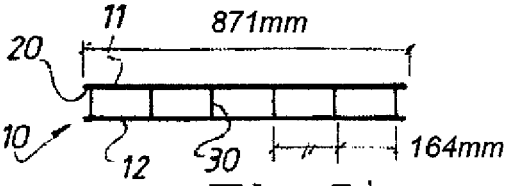
Figure 9K:
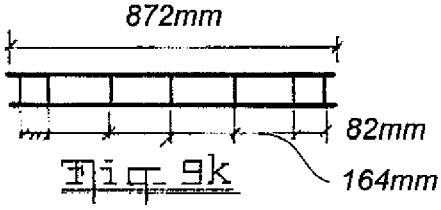
Figure 9L:
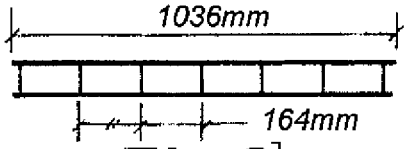
Figure 9M:
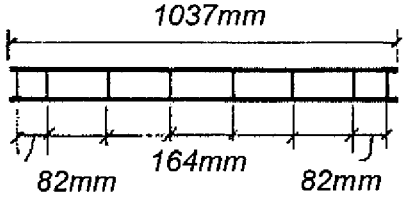
Figure 9N:
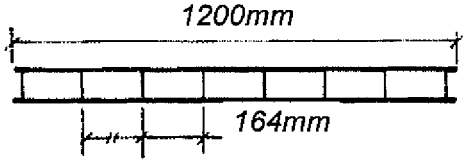

As shown in FIGS. 7 and 8, end elements 40 surround the hole cut in the facing sheets 11, 12 for the provision of a window assembly 60. The lower frame member 61 of the window assembly 60 is fixed to a bottom plate 50 extending long the window sill 62. The remaining side and top frame members 63, 64, 65 are fixed to the infill members 13, cut from the facing sheet material, and received in channels 48 defined by web 45 and L-shape flange 46 in end members 40. It will be noted that screws 49 anchor the end members 40 to the facing sheets 11, 12. The infill members may be formed from facing sheet material. Alternatively, the infill material may be formed as a specific extrusion from a material such as aluminium. The extrusion may have an outwardly extending weather fin formed to provide additional protection in use. It is preferred if the outer corner of the end member between flange 42 and web 43 is formed as a slight curve. For example, a 2 mm radius is appropriate. This avoids the need to form external corners in finishing as a finishing layer may be set to the track.

Figure 6:
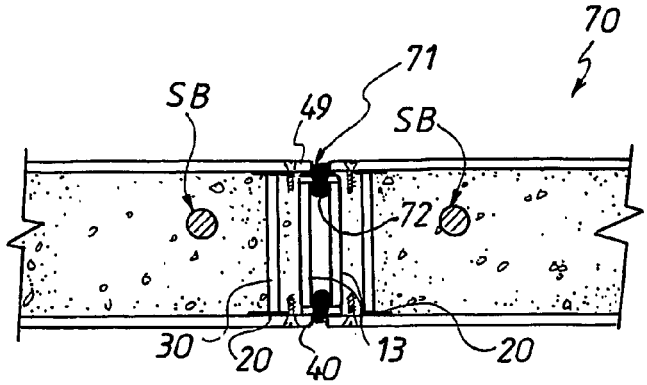
FIG. 6 is a top sectional view of a construction joint between adjacent panels.

As shown in FIG. 6, the end members 40 support infill members 13 down the sides of the panels 10 at a construction joint 70, where screws 49 each pass through a facing sheet 11, 12, flange 41 of an end element 40 and head 21 of stud 20. Fire-rated sealant 71, with a back-up rod 72, is interposed between the adjacent pairs of end elements 40 to provide a fire-resistant seal between two panels 10 at the construction joint 70.

Figure 11A:
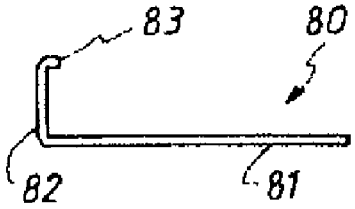
FIGS. 11(*a*) to (*c*) are respective views of a joiner element for joining the panels.
Figure 11B:
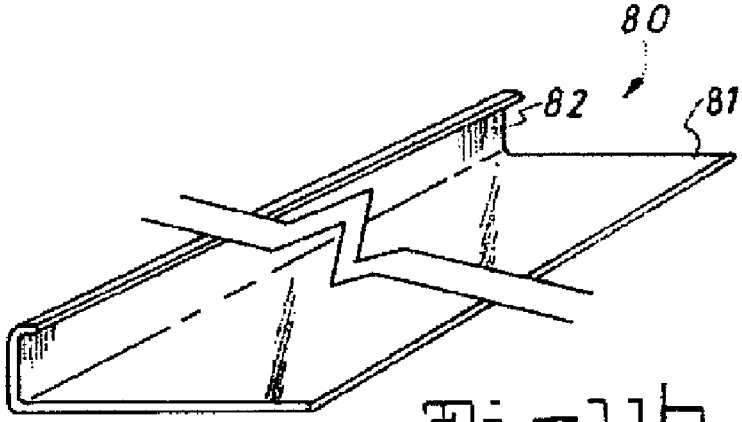
Figure 11C:
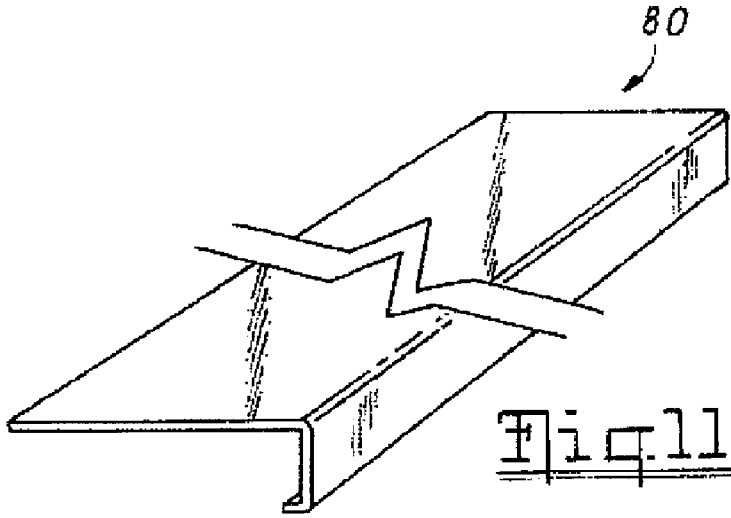

As shown in FIG. 5, joiner element 80, shown in more detail in FIGS. 11(*a*) to (*c*) is used to adjoin to adjacent panels 10 together. The joiner element 80 is substantially L-shaped, with a body 81 and flange 82 with lip 83. Preferably, the joiner 80 is extruded from aluminium and may be cut to modular lengths of 100 mm or multiples thereof.

Prior art systems require panels to be erected in one direction due to joiners being fixed to panel edges or, alternatively, a joiner panel required lowering from above. The present system can be commenced from both ends and work towards the middle. No panel to panel joiner is required due to facing sheets being fully supported at panel joins. This allows a panel to be erected between two standing panels to close all opening.

As shown in FIG. 5, the flange 80 is nested against one of the flanges 22, 23 of a stud 20 and the body 81 overlies the heads 21 of adjacent studs 20 of adjacent panels 10. Screws 49 are driven through the facing sheets 11 or 12, heads 21 of the studs 20 and the body 81 of the joiner element to connect the panels together.

Figure 13A:
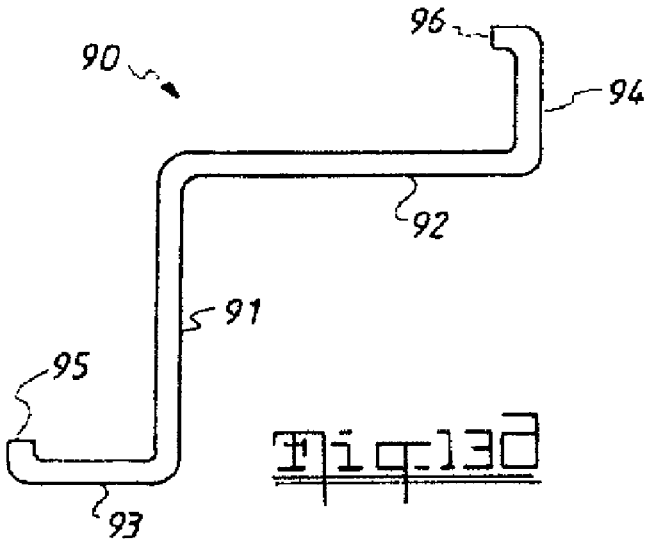
FIGS. 13(*a*) to (*c*) are respective views of an internal corner.
Figure 13B:
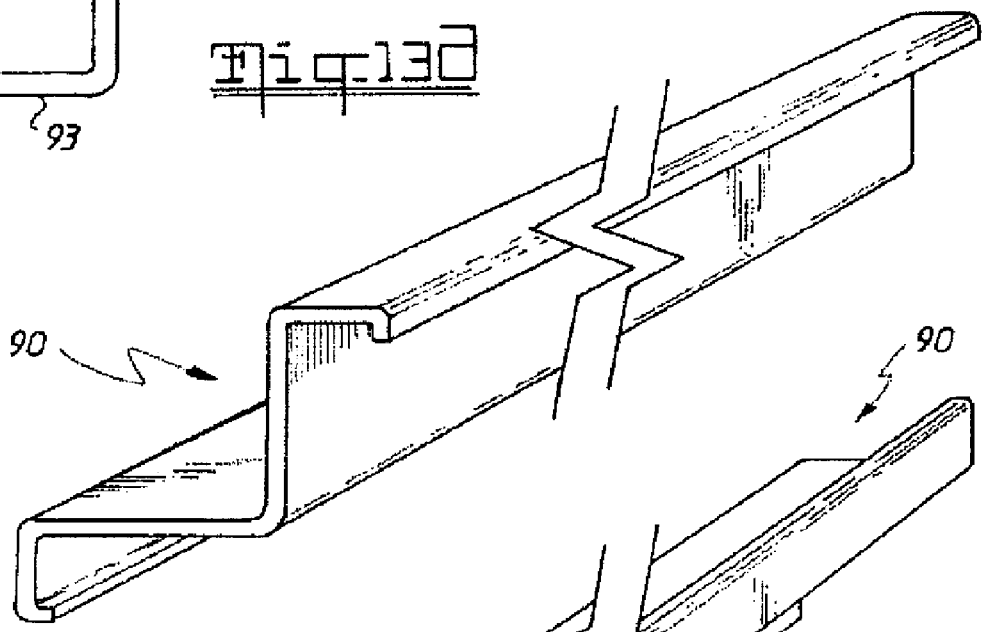
Figure 13C:
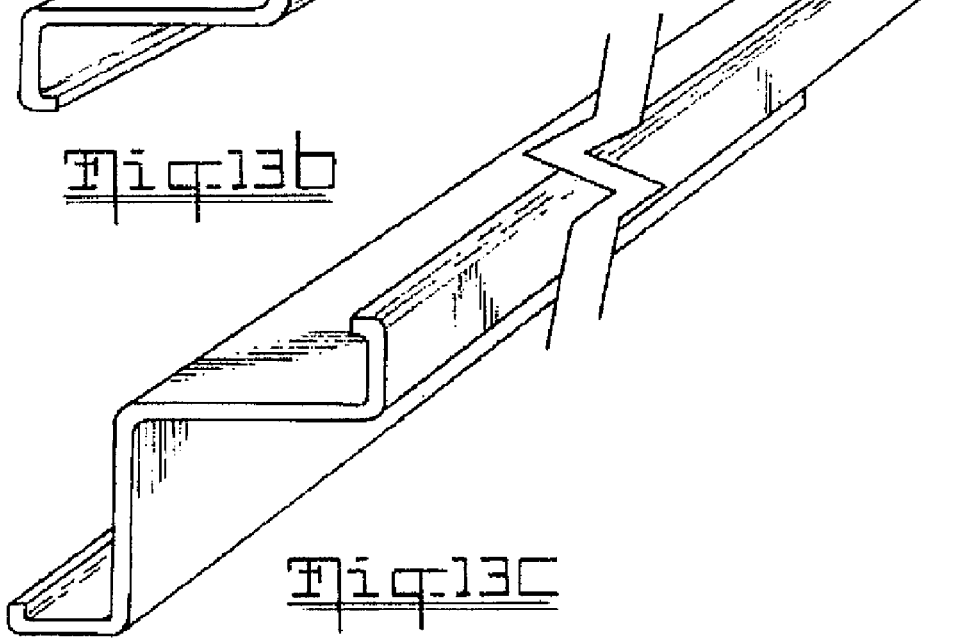

At a typical corner, illustrated at the lower left corner of FIG. 5, the adjacent facing sheets 11, 12 of the panels 10 are connected by an inner or internal corner 90 shown in more detail in FIGS. 13(*a*) to (*c*). The internal corner 90 is of substantially "w-shape", with webs 91, 92 at right angles and terminated by flanges 93, 94 with lips 95, 96.

The webs 91, 92 overlie the heads 21 of the adjacent studs 20 and the flanges 93, 94 are nested with the flanges 22, 23 thereof.

Screws 49 pass through the facing sheets 11 or 12, heads 21 of the studs 20 and the webs 91 or 92 of the internal corners 90 to secure the panels together.

After the horizontal reinforcing elements have been inserted into the panels 10 (through the spaces between the spacer elements 30) and tied together, an external corner 100, shown in more detail in FIGS. 12(*a*) to (*c*) is located to enclose the corner. This is particularly advantageous as cogged reinforcing members may be positioned with subsequent easy completion of the corner.

The external corner 100, extruded from aluminium or plastics material like the inner corner 90, has webs 101, 102 at a suitable angle. The external corner is preferably at just less than 90° and preferably 89° or thereabouts. This allows finishing with a high level of linear accuracy. Each web 101, 102 is terminated by a flange 103, web 104 and lip flange 105.

The external corner 100 is either inserted vertically, or one side is engaged with one panel 10 and other side is "sprung" into position with the second panel 10.

It will be noted that each web 104 overlies a head 21 of a stud 20 and the lip flange 105 is nested with the flange 22, 23 of a stud 20. A screw 49 passes through the facing sheet 11 or 12, head 21 of the stud 20 and web 104 of the external corner to secure the components together.

The external corner 100 provides an accurate joint line against which a plasterer can finish the corner.

At a typical squint corner, shown at the lower right hand of FIG. 5, the right-angled internal corner 90 and external corner 100 are replaced by purpose made internal and external corners 90A, 100A of the desired internal angle eg. 112.5°/120°/135°/150°.

At an internal junction between two panels 10, shown in FIG. 5, a top or bottom plate 50 is provided down one side of the panel 10 (forming the "leg" of the T-junction), the top or bottom plate 50 being received in channels 47 in end elements 40. Screws 49 fix the top or bottom plate 50 to the facing sheet 11 or 12 of the adjacent panel 10.

FIG. 2 illustrates a typical building system for multi-storey building construction, where superimposed panels 10 are connected to a concrete floor slab 120. It will be noted that starter bars SB interconnect the upper- and lower-storey panels 10 and pass through the bond beam 121 at the edge of the floor slab 120. A bond beam 122 interconnects the upper ends of the upper-storey panels 10, extending along the panels 10 above the upper ends of the studs 20. This is also one of the advantages of the present system in that a regular uninterrupted beam is formed around the top of the panel.

A bottom element 40A, shown in more detail in FIGS. 13(*a*) to (*c*), is provided along the outer lower edge of the upper-storey panel 10 and it will be noted that flange 42A has an extension of lip 42B which extends over a recess or "shadow line" 123 in the concrete slab 120 below the junction with the upper-storey panel 10.

Figure 17A:
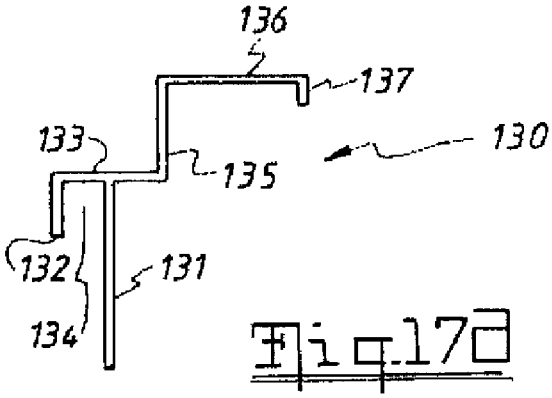
FIGS. 17(*a*) to (*c*) are respective views of an edge form rebate.
Figure 17B:
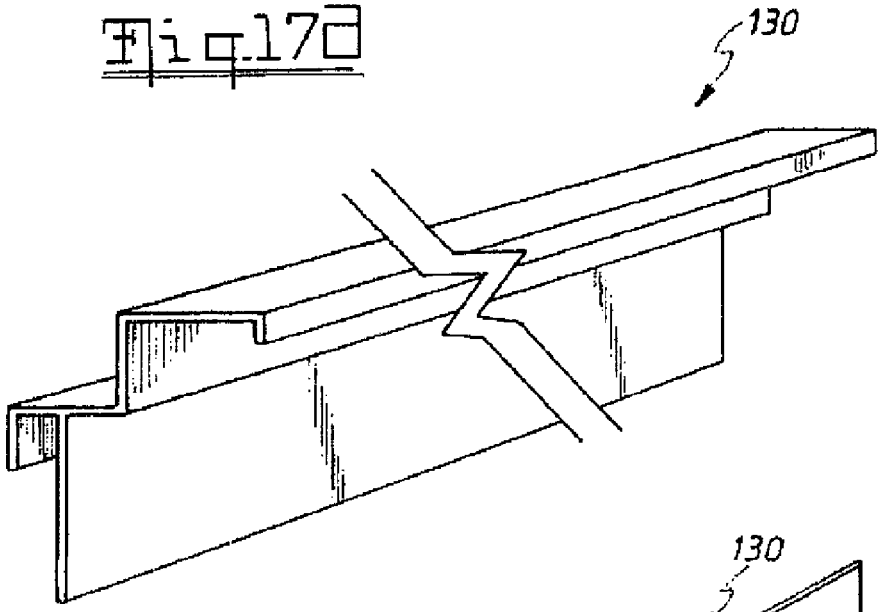
Figure 17C:
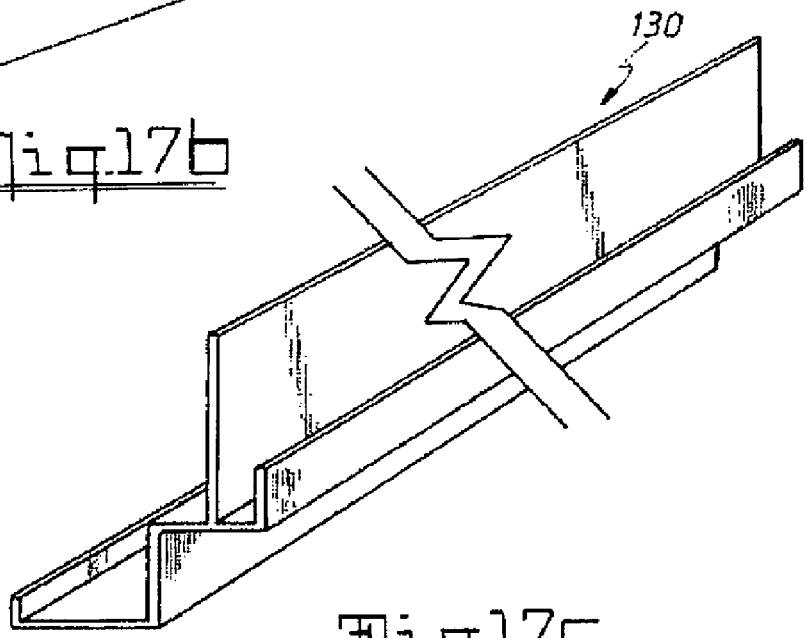

The top edge of the outer facing sheet 11 or 12 of the lower-storey panel 10 is provided with an edge form rebate 130, shown in more detail in FIGS. 17(*a*) to (*c*).

The edge form rebate 130 has flanges 131, 132 connected by a web 133 to form a channel 134 to receive the facing sheet 11, 12 of the lower-storey panel 10. Flange 135 connects web 133 to a web 136 with a lip 137. The web 136 engages, and may be fixed to, a bottom plate 50 of the upper-storey panel 10. The bottom plate 50 is fixed by at least one correct concrete fixing screw 49A to the concrete floor slab 120. The top surface of web 136 also acts as a guide for screeding the slab.

It will be readily apparent to the skilled addressee that respective profiles of the studs 20, end elements 40, joiner elements 80, internal corners 90, bottom elements 40A and edge form rebates 130 are common to all panel heights/widths/thicknesses. This means that these components can all be extruded and cut to length as required.

In one embodiment, spacer elements 30 can be cut from the waste of the (eg. fibre-cement) sheets from which the facing panels 11, 12 are cut, to enable the panels to be of the desired final thickness (eg. 115 mm/135 mm/150 mm/200 mm).

Respective top and bottom plates 50 and external corners 100 are required for each panel thickness, but these can be extruded and cut to length as required.

It will, however, be readily apparent to the skilled addressee that the number of different components required to manufacture a wide range of panel heights/widths/thicknesses can be markedly reduced to simplify inventory management, reduce inventory holding costs, and enable computer-aided designs/ordering/manufacture of the panels for a particular building installation.

The panels 10 and associated components are designed for easier erection and installation of the building reinforcing elements and the concrete; while ensuring all relevant standards are met.

The end elements 40, top and bottom plates 50, and the ability to provide a "shadow line" joint, ensure accurate/aesthetic connection between adjacent panels 10 (and eg. floor slabs 120).

In addition, the end elements 40 and external corners 100 provide accurate guides for plasterers applying finishes to the facing sheets 11, 12.

Throughout the specification, the aim has been to describe the preferred embodiments of the invention without limiting the invention to any one embodiment or specific collection of features. Those of skill in the art will therefore appreciate that, in light of the instant disclosure, various modifications and changes can be made in the particular embodiments exemplified without departing from the scope of the present invention. All such modifications and changes are intended to be included within the scope of the appendant claims.

The invention claimed is:

1. A form work panel for solid filled walls, including:

a pair of facing sheets spaced apart by a plurality of stud assemblies, the stud assemblies each having a pair of parallel strip-like studs held together by a plurality of spacer elements, the studs each having a head attached to a respective panel, the head having a relatively broad flat surface directly abutting against and bonded and/or fastened to an inner face of the panel facing sheet, and a pair of spaced, opposed flanges which extend from a central portion of the head into the interior of the panel, the flanges formed integrally with the head such that the flanges and a portion of the head spanning between the flanges define a recess, each flange having an out-turned terminal lip to guide passage of the spacer element into the recess, the out-turned terminal lips defining a widening of the recess, each spacer element in a stud assembly having tongues which engage respective recesses in the pair of studs, and each recess in a stud having teeth formed on the flanges to engage the tongues of the spacer elements.

2. A panel according to claim 1 wherein the head of each stud attached to a respective facing sheet is substantially wider than the width of the spacer elements.

3. A panel according to claim 1 wherein the width of the head of each stud is more than double the width of the recess formed by the flanges.

4. A panel according to claim 1 wherein each head is attached to a respective panel by way of adhesive.

5. A solid filled wall including a panel as claimed in claim 1 filled with concrete.

6. A panel according to claim 1 wherein the teeth compressively engage an outer surface of the tongues.

7. A panel according to claim 1 wherein, the tongues have a width substantially similar to a width of the recesses so as to give an over dimension to the teeth relative to the tongues.

8. A panel according to claim 1 wherein at least one of the studs is positioned so that the head of the stud extends substantially to a side edge of the respective facing sheet.

9. A panel according to claim 8 wherein the head of the at least one stud is for allowing attachment of at least one of:

an end element for allowing an end of a panel to be closed;

a joiner element for allowing two adjacent panels to be joined together; and, a corner element for allowing two angled panels to be joined together.

* * * * *